US008128193B2

(12) United States Patent
Suzuki

(10) Patent No.: US 8,128,193 B2
(45) Date of Patent: Mar. 6, 2012

(54) PRINTER

(75) Inventor: Seiji Suzuki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 287 days.

(21) Appl. No.: 12/466,843

(22) Filed: May 15, 2009

(65) Prior Publication Data

US 2009/0309916 A1 Dec. 17, 2009

(30) Foreign Application Priority Data

Jun. 12, 2008 (JP) ..... 2008-153999

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS 5,146,239 A * 9/1992 Ono ..... 347/171
5,903,287 A * 5/1999 Ishikawa et al. ..... 347/24
6,390,592 B2 5/2002 Okamura
6,913,340 B2 7/2005 Tanaka et al.
2008/0001988 A1* 1/2008 Tanaka ..... 347/32
2009/0040252 A1 2/2009 Tanaka et al.

* cited by examiner

*Primary Examiner* — Matthew Luu
*Assistant Examiner* — Alejandro Valencia
(74) *Attorney, Agent, or Firm* — Fitzpatrick, Cella, Harper & Scinto

(57) ABSTRACT

A cleaning mechanism has a slider moving together with a carriage and a suction cap provided on the slider to cap one of print heads mounted on the carriage to perform suction therefrom. A first contact portion and a second contact portion are provided in each of the carriage and the slider, and a third contact portion and a fourth contact portion are provided in the slider. In the case that the suction cap performs suction from a black head, when the carriage moves toward the cleaning mechanism side, the first contact portion and the third contact portion come into contact with each other to position the carriage and the slider in such a manner that the suction cap faces the black head. On the other hand, in the case that the suction cap performs suction from a color head, when the carriage moves toward the cleaning mechanism side, the second contact portion and the fourth contact portion come into contact with each other to position the carriage and the slider in such a manner that the suction cap faces the color head.

5 Claims, 13 Drawing Sheets

PRINTER

BACKGROUND OF THE INVENTION

1. Field of the Invention

The present invention relates to an inkjet printer which discharges ink from a print head to perform printing.

2. Description of the Related Art

The inkjet printer discharges ink from multiple micro nozzles provided in a print head to perform printing. Ink in the nozzles dries, thickens, and adheres with a lapse of time when the printer remains not in use. Print quality may also be deteriorated by poor discharge of ink due to clogged nozzles caused by the mixing of paper powder, dust, air bubbles, etc. into the ink.

To prevent these problems, there is known a cleaning mechanism for cleaning a print head in a position outside a printing zone of the print head mounted on a carriage. For example, a slider holding a cap is provided in the cleaning mechanism so that the movement of the slider will follow the movement of the carriage. In this case, the print head is capped and a negative pressure is generated in the cap to suck ink from the clogged ink nozzles. U.S. Pat. Nos. 6,390,592 and 6,913,340 disclose inkjet printers with such a cleaning mechanism.

SUMMARY OF THE INVENTION

It is the primary object of the present invention to improve conventional printers with cleaning mechanisms. It is more specific object of the present invention to provide an excellent printer capable of selecting, by a simple mechanism, a print head to be cleaned from plural print heads mounted on a carriage.

To accomplish the objects, the present invention provides a printer comprising a carriage with a first print head and a second print head mounted thereon moving reciprocally within a range including a printing zone, the first print head and the second print head having nozzles for discharging ink toward a print medium, respectively and a cleaning mechanism having a slider moving together with the carriage and a suction cap provided on the slider to cap one of the first and the second print heads mounted on the carriage and perform suction, wherein a first contact portion and a second contact portion are provided in the carriage, and a third contact portion and a fourth contact portion are provided in the slider, in the case that the suction cap performs suction from the first print head, when the carriage moves toward the cleaning mechanism side from the printing zone, the first contact portion and the third contact portion come into contact with each other to position the carriage and the slider in such a manner that the suction cap and the first print head face each other, and in the case that the suction cap performs suction from the second print head, when the carriage moves toward the cleaning mechanism side from the printing zone, the second contact portion and the fourth contact portion come into contact with each other to position the carriage and the slider in such a manner that the suction cap and the second print head face each other.

Further features of the present invention will become apparent from the following description of exemplary embodiments with reference to the attached drawings.

DESCRIPTION OF THE EMBODIMENTS

First Embodiment

Figure 1:
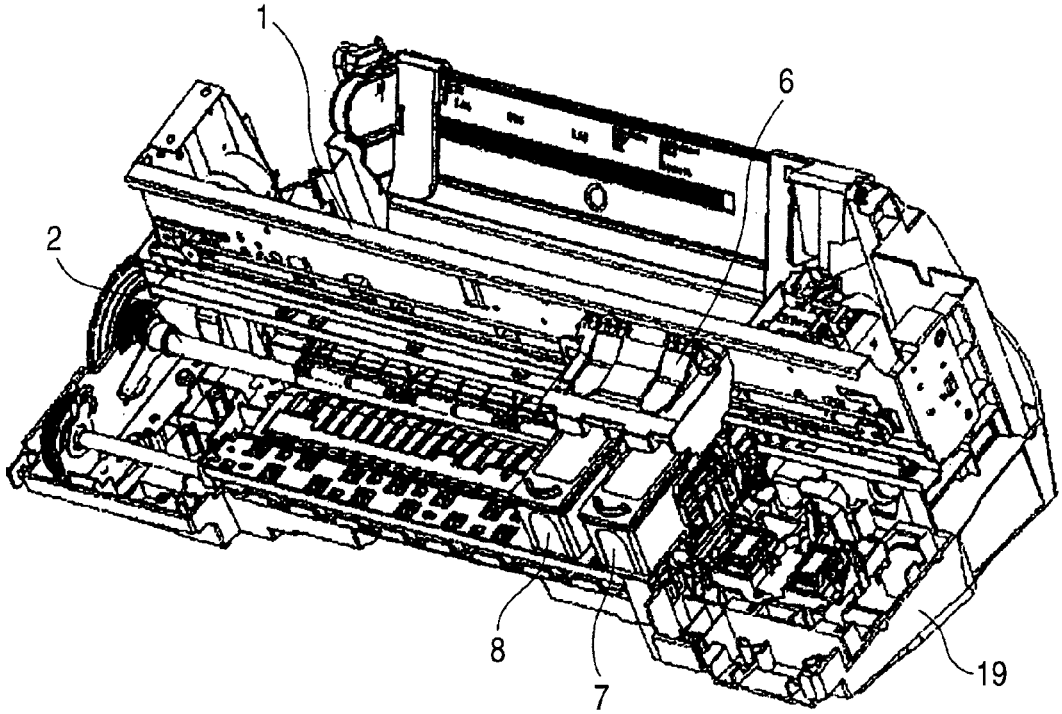
FIG. 1 is a perspective view illustrating the structure of an inkjet printer.

FIG. 1 is an outline view of an inkjet printer in an embodiment of the present invention. A printer body includes a carriage 6 on which a black head (first print head) 8 for discharging black ink and a color head (second print head) 7 for discharging color ink are mountable. The carriage 6 with the color head 7 and the black head 8 mounted thereon moves reciprocally within a predetermined range including a printing zone of the printer in a main scanning direction (hereinafter simply referred to as "printing zone") with respect to a chassis 1. A conveying roller 2 provided in the printer body conveys a sheet as a print medium in a sub-scanning direction each time the main scanning of the carriage 6 is completed, and these actions are repeated to print a two-dimensional image on the sheet. A cleaning mechanism is provided in a position opposite to the carriage 6 and outside the printing zone in the predetermined range.

Figure 2:
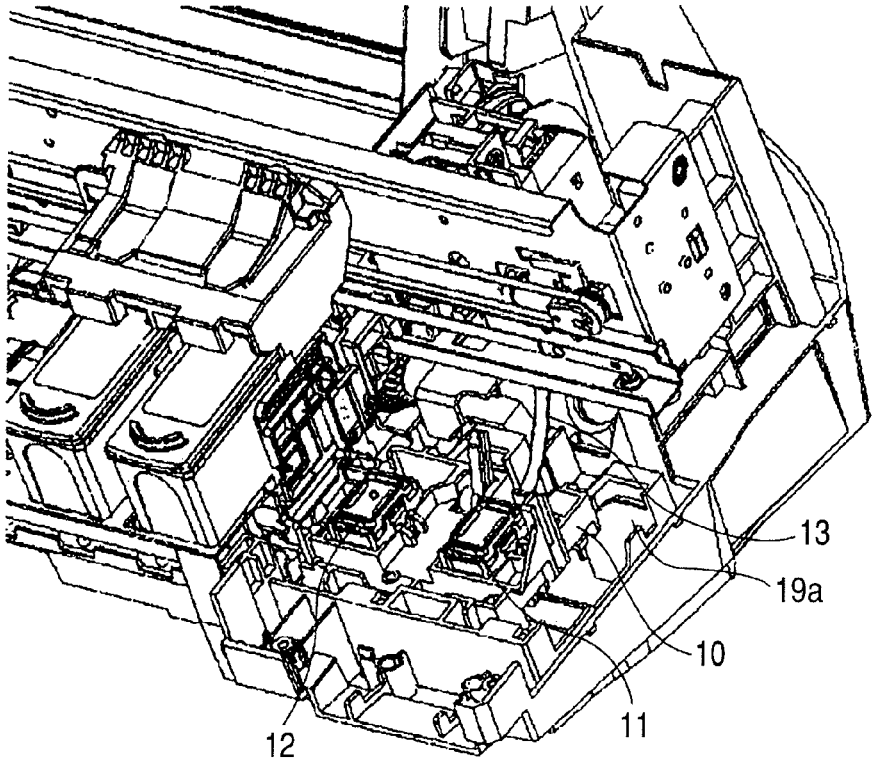
FIG. 2 is a perspective view illustrating the structure of a cleaning mechanism and a carriage as seen from the top side.
Figure 3:
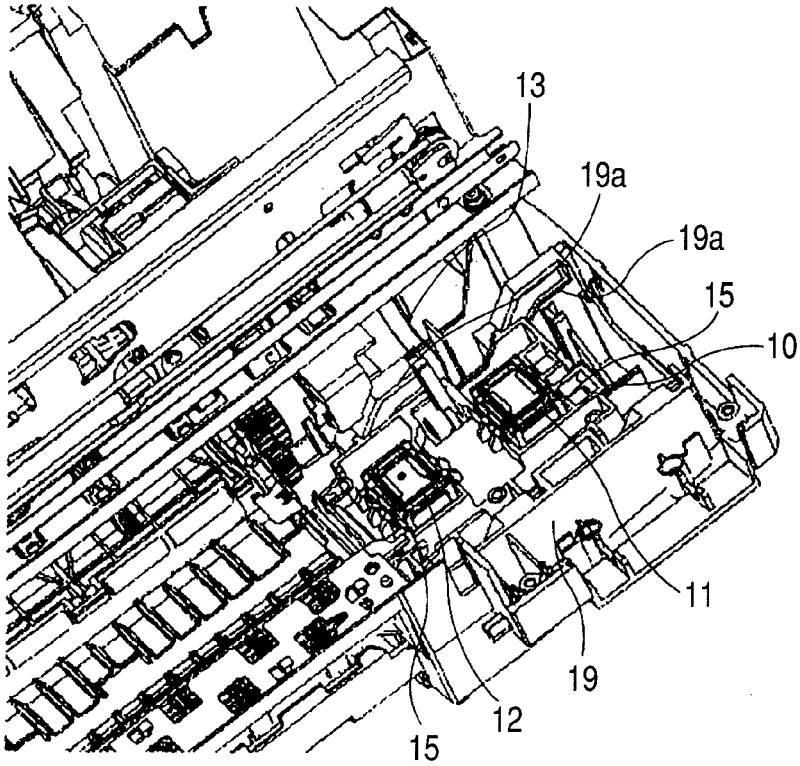
FIG. 3 is a perspective view illustrating the cleaning mechanism as seen from the top side.

FIG. 2 and FIG. 3 are schematic perspective views illustrating the structure of the cleaning mechanism. In the cleaning mechanism, a suction cap (first cap) 12 and a protective cap (second cap) 11 are held by a slider 10 through a cap holder 15. The slider 10 follows the movement of the carriage 6 to move along a cam surface 19*a* provided on a base 19 and perform capping when the carriage 6 enters the cleaning mechanism. A pump tube 13 for sucking ink by means of a pump 40 is connected to the suction cap 12.

Figure 4:
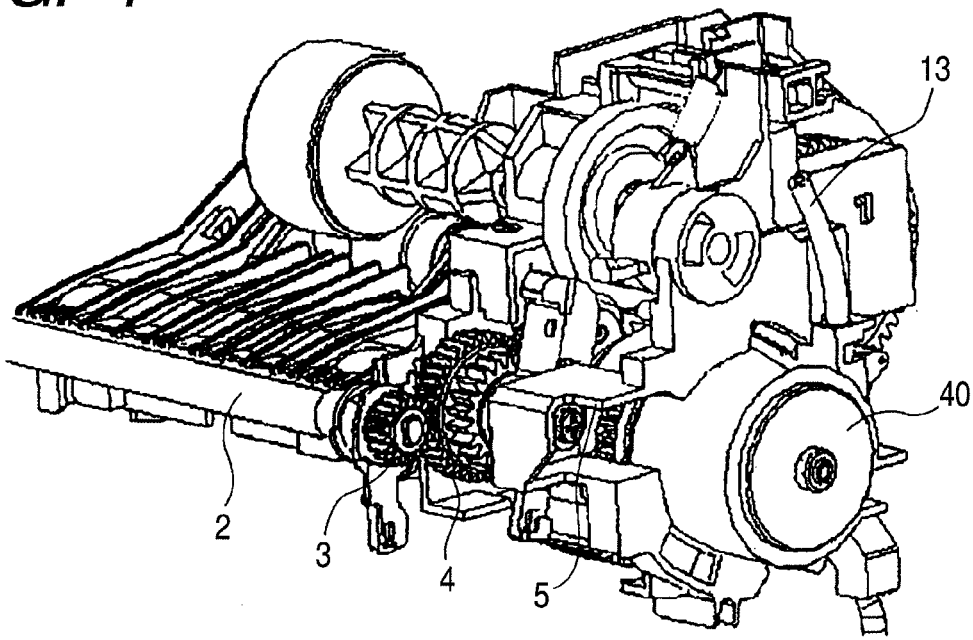
FIG. 4 is a perspective view illustrating the structure of drive transmission from a conveying roller to a pump section.
Figure 5:
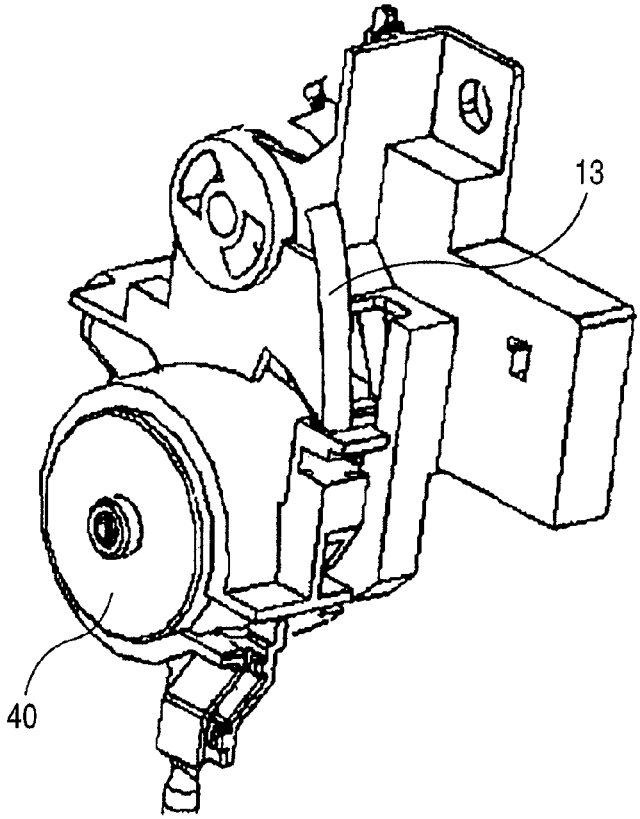
FIG. 5 is a perspective view illustrating the pump section as seen from the back of the body.
Figure 6:
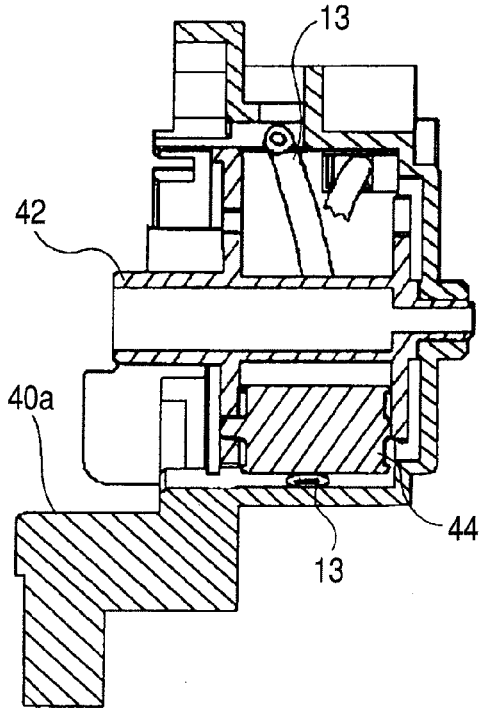
FIG. 6 is a schematic sectional view illustrating the internal structure of a pump base.

FIG. 4 to FIG. 6 illustrate a pump mechanism section according to the present invention. FIG. 4 is a perspective view illustrating the pump mechanism section as seen from the side of connection with a drive gear train. FIG. 5 is an outline perspective view of the pump mechanism section. FIG. 6 is a sectional view illustrating the entire internal structure of a pump base as the pump mechanism section. The pump 40 has a pump roller 44 in a pump roller holder 42 to which the pump roller 44 is attached. The pump tube 13 is arranged to creep round the pump mechanism section along the inner walls of the pump base 40*a* with the pump roller 44 connected, and it is so inserted that the pump roller holder 42 can rotate. When the conveying roller 2 is reversely driven in such a state that the print heads 7 and 8 are capped, a driving force is transmitted to the pump roller holder 42 through an output gear 3, an idler gear 4, and a pump driving gear 5. As a result, a negative pressure can be generated in the pump tube 13 by means of the pump roller 44 inside the pump base 40*a*, so that ink is sucked from ink nozzles of the print head 7 or 8 through the suction cap 12. Upon releasing the negative pressure in the pump tube 13 after completion of the suction, the pump roller holder 42 is driven to rotate toward the opposite side (normal rotation side of the conveying roller) to cause the pump roller 44 to release the crushed state of the tube 13. This enables releasing of the negative pressure in the tube.

Figure 7:
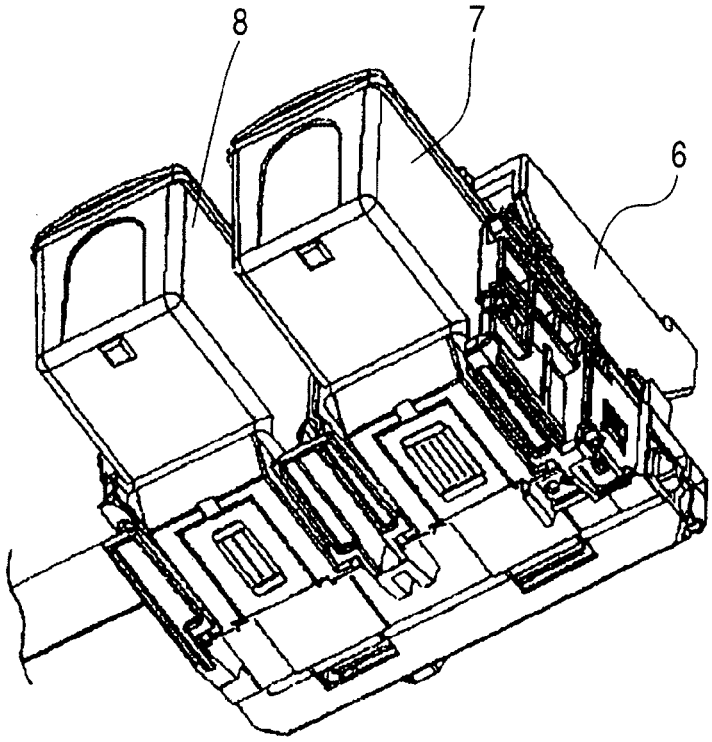
FIG. 7 is a perspective view illustrating such a state that a color head and a black head are mounted on the carriage.

FIG. 7 is a perspective view as seen from the ink nozzle side, illustrating the carriage 6 with the color head 7 and the black head 8 mounted thereon. There are various conditions for ink suction from the ink nozzles to clean a print head and for preliminary discharge. In a print head for discharging black ink as pigmented ink, ink is more likely to adhere to the ink nozzles than a case where dye ink is used. Therefore, when printing is performed after the ink nozzles remain capped for a certain period, a technique is employed, which performs ink suction before printing to remove thickened ink from the ink nozzles in order to maintain good print quality. On the other hand, in a print head for discharging color ink as dye ink, since ink is less likely to thicken and adhere to the ink nozzles even if the ink nozzles have been capped for a certain period, there is no need to perform ink suction in normal use. In this regard, however, if printing is performed in succession, not only preliminary discharge operation for discharging a predetermined amount of ink during printing but also wiping are performed during printing to reduce the harmful effects on discharging due to adhesion of a mist of ink to the ink discharge face in order to stabilize printing quality. In other cases where printing quality is not stable for any reason, suction may be performed at the discretion of a user of the printer.

Figure 8:
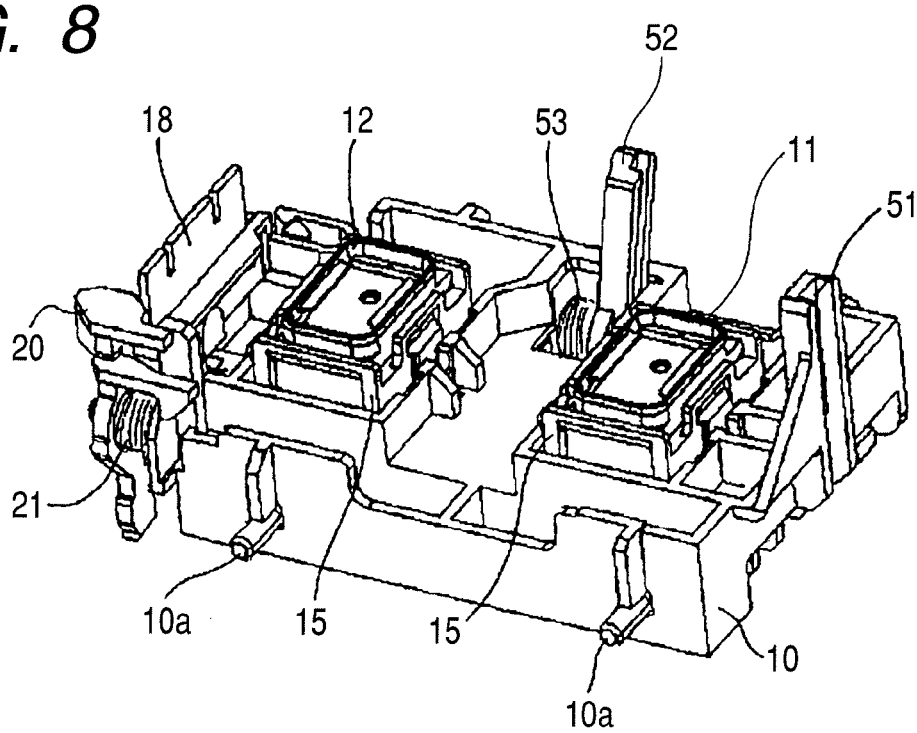
FIG. 8 is a perspective view illustrating the structure of a slider section as the cleaning mechanism as seen from the top side.
Figure 9:
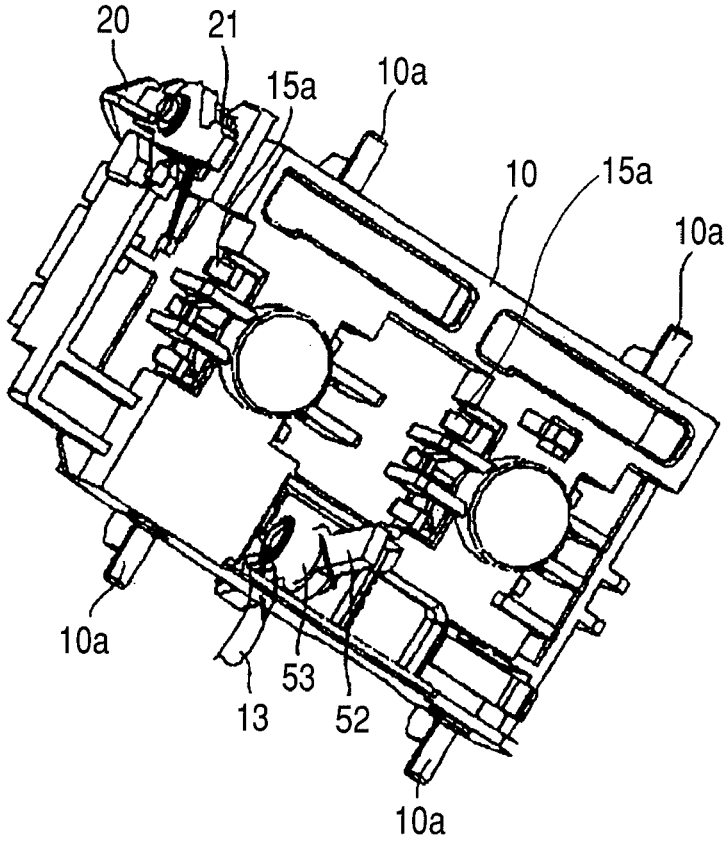
FIG. 9 is a perspective view illustrating the structure of the slider section as the cleaning mechanism as seen from the bottom side.
Figure 11:
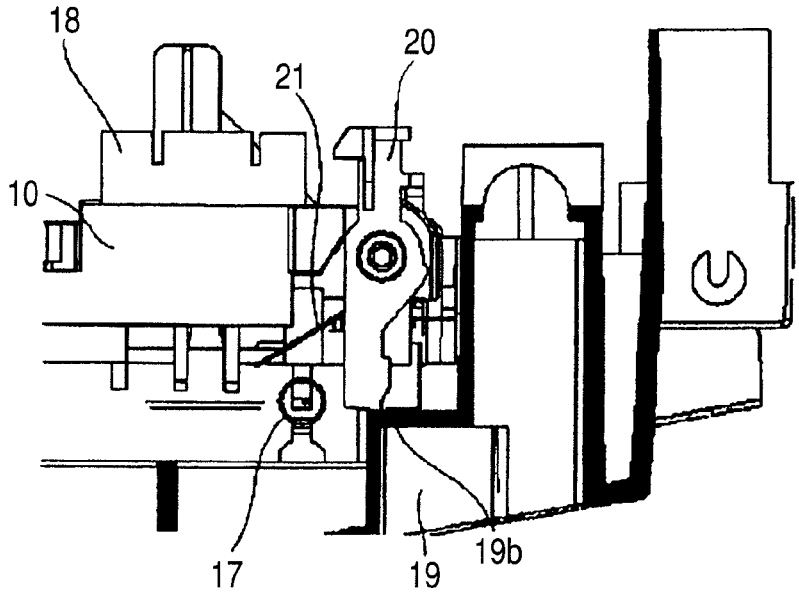
FIG. 11 is a schematic side view illustrating such a state that the slider is locked.

FIG. 8 and FIG. 9 illustrate the details of the cleaning mechanism according to the present invention. The protective cap 11 and the suction cap 12 are held at a limited height not to go off the slider 10 even if a cap spring force is acting thereon by means of locking claws 15*a* of the cap holder 15. When the carriage 6 is positioned on the printing zone side, the slider 10 is biased and statically determinate to position on the printing zone side by means of a slider spring 17 (FIG. 11).

Figure 13:
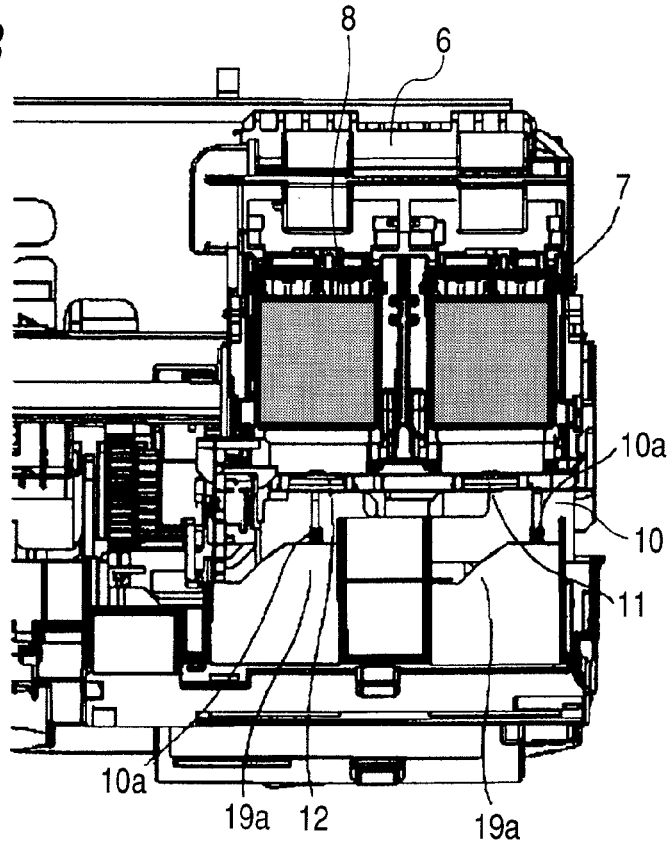
FIG. 13 is a view illustrating a positional relationship between the carriage and the slider in a first embodiment.
Figure 15:
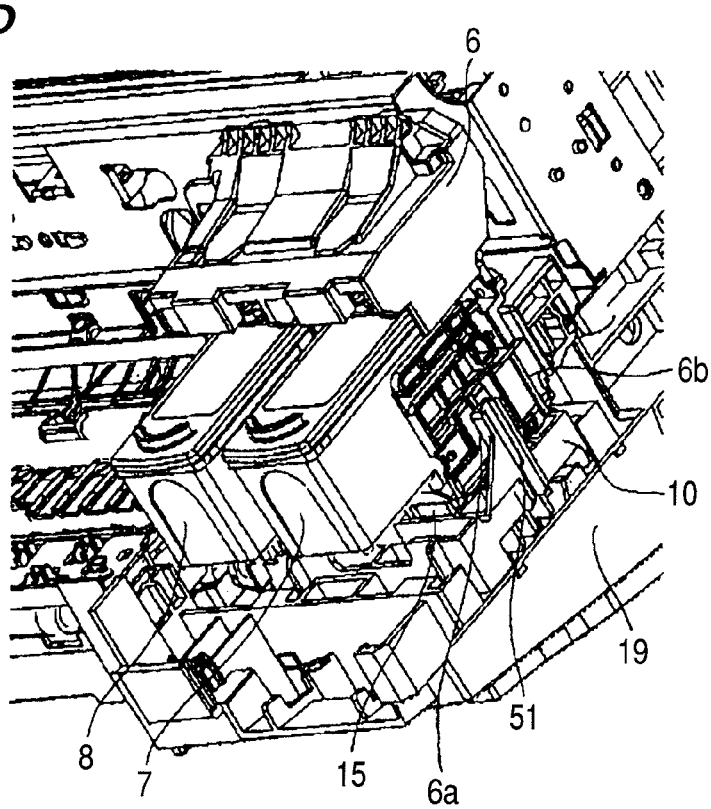
FIG. 15 is a top perspective view illustrating a positional relationship when suction from the black head is performed.
Figure 17:
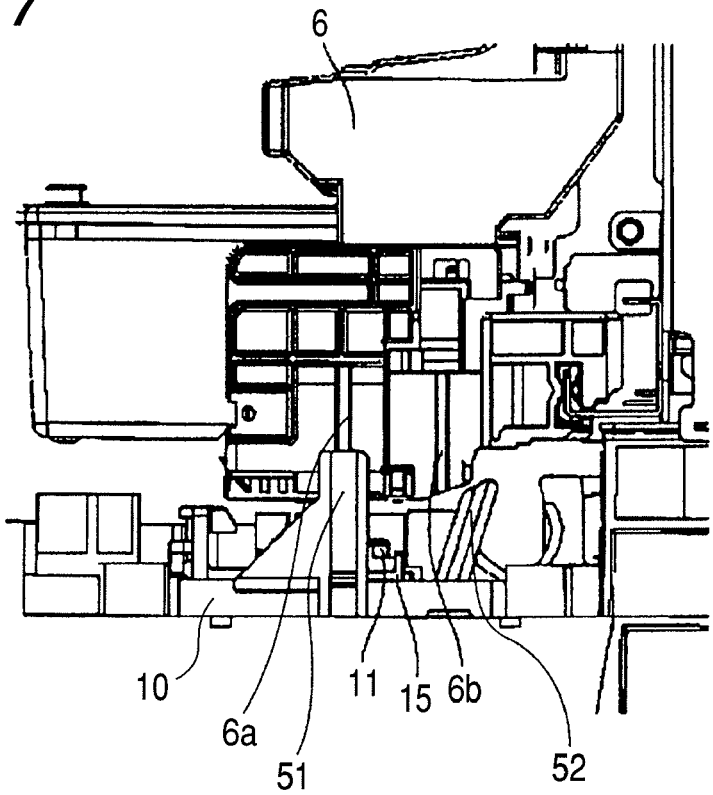
FIG. 17 is a side view illustrating the positional relationship when suction from the black head is performed.

FIG. 13 is a view illustrating a positional relationship between the carriage 6 and the slider 10 when the suction of ink from the black head 8 is performed. FIG. 15 is a top perspective view illustrating the positional relationship between the carriage 6 and the slider 10 when the suction of ink from the black head 8 is performed. FIG. 17 is a side view illustrating the positional relationship between the carriage 6 and the slider 10 when the suction of ink from the black head 8 is performed.

Figure 14:
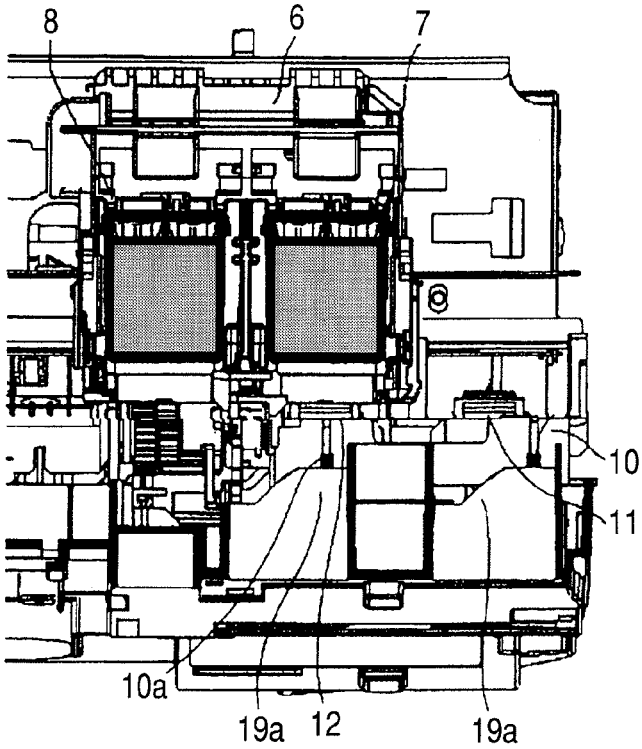
FIG. 14 is a view illustrating a positional relationship when suction from the color head is performed.
Figure 16:
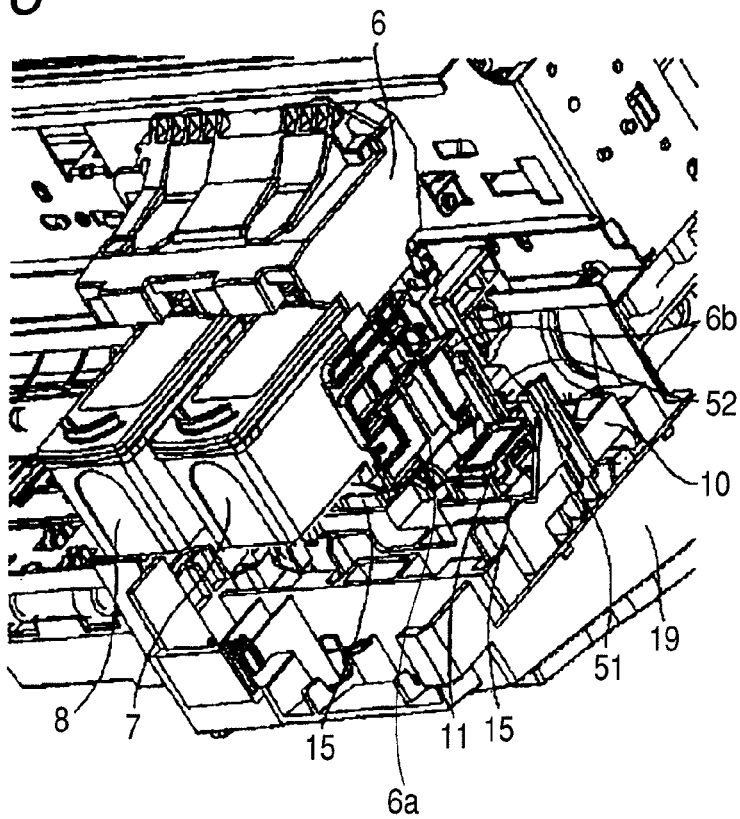
FIG. 16 is a top perspective view illustrating a positional relationship when suction from the color head is performed.
Figure 18:
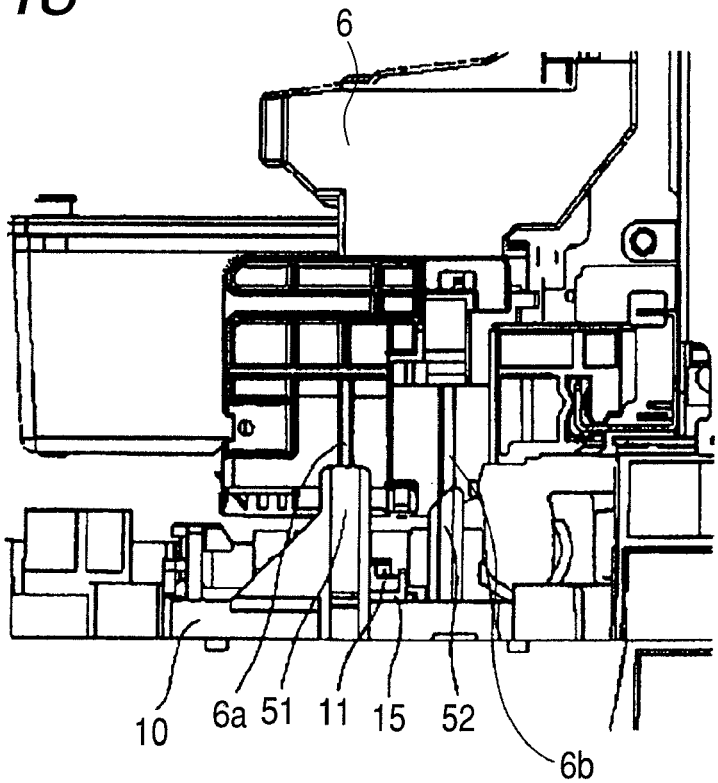
FIG. 18 is a side view illustrating the positional relationship when suction from the color head is performed.

FIG. 14 is a view illustrating a positional relationship between the carriage 6 and the slider 10 when the suction of ink from the color head 7 is performed. FIG. 16 is a top perspective view illustrating the positional relationship between the carriage 6 and the slider 10 when the suction of ink from the color head 7 is performed. FIG. 18 is a side view illustrating the positional relationship between the carriage 6 and the slider 10 when the suction of ink from the color head 7 is performed.

Figure 19:
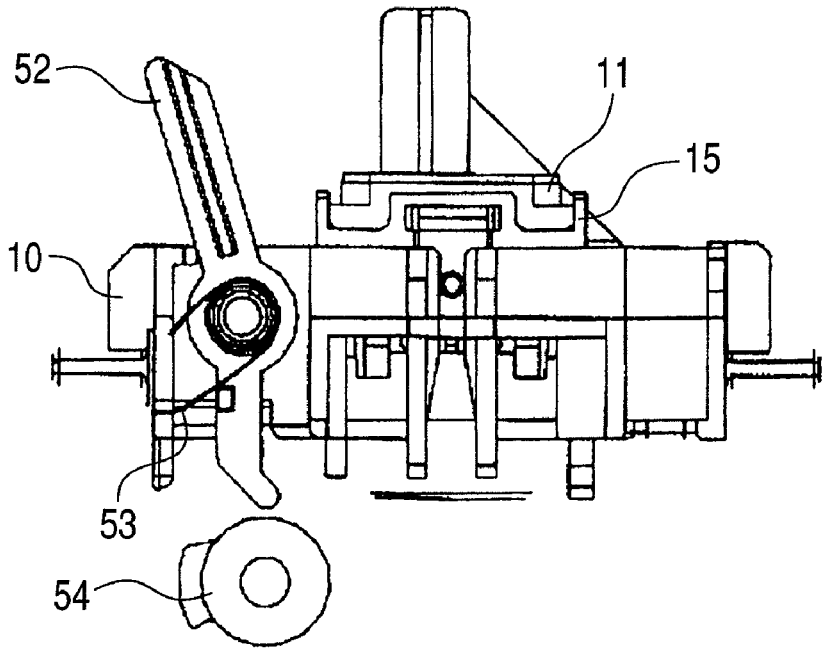
FIG. 19 is a view illustrating a positional relationship when suction from the black head is performed.
Figure 20:
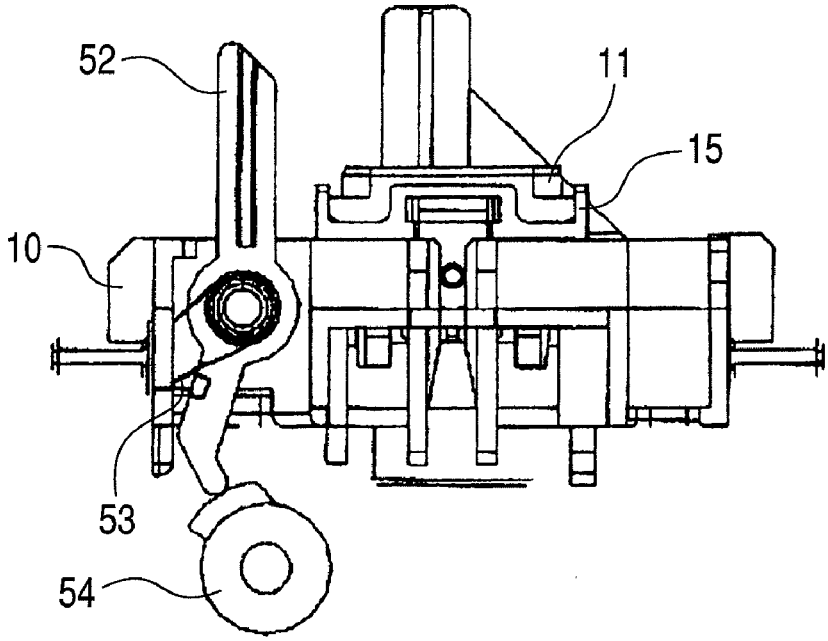
FIG. 20 is a view illustrating a positional relationship when suction from the color head is performed.

FIG. 19 is a view illustrating a positional relationship between a trigger lever 52 and a cam 54 when the suction of ink from the black head 8 is performed. FIG. 20 is a view illustrating a positional relationship between the trigger lever 52 and the cam 54 when the suction of ink from the color head 7 is performed. The cam 54 receives rotation of the conveying roller 2 as driving power to rotate through plural gears. The cam 54 makes the trigger lever 52 displaceable. The trigger lever 52 can be changed to either a down state illustrated in FIG. 19 or a standing state illustrated in FIG. 20.

The following describes a case where the suction of ink from the black head 8 is performed. The carriage 6 moves from the printing zone toward the cleaning mechanism side in which the protective cap 11 and the suction cap 12 are held by the slider 10. As a result, a first contact portion 6*a* of the carriage (first contact portion) and a contact portion 51 of the slider (third contact portion) come into contact with each other. This results in determining the relative position of the carriage 6 and the slider 10 in such a manner that the suction cap 12 faces the nozzles of the black head 8 and the protective cap 11 faces the nozzles of the color head 7. When the carriage 6 further moves from this state, the slider 10 moves together with the carriage 6, and the slider 10 is pushed in to the position illustrated in FIG. 13 on the top of the cam surface 19*a* of the base. This enables the suction cap 12 to cap the black head 8 and the protective cap 11 to cap the color head 7. In the case of ink suction from the black head 8, the trigger lever 52 (fourth contact portion) mounted in the slider 10 is retained by a slide trigger lever spring 53 (FIG. 19) in the down state as illustrated in FIG. 17 so as not to come into contact with a second contact portion 6*b* of the carriage.

On the other hand, when the suction of ink from the color head 7 is performed, the trigger lever 52 is maintained in the standing state as illustrated in FIG. 20 by means of the cam 54 that has the conveying roller 2 as the driving source to rotate through plural gears. The positional relationship between the trigger lever 52 and the carriage 6 is as illustrated in FIG. 18. When the carriage 6 moves from the printing zone toward the cleaning mechanism side, the second contact portion 6*b* of the carriage first comes into contact with the trigger lever 52. This results in determining the relative position of the carriage 6 and the slider 10 in such a manner that the suction cap 12 faces the nozzles of the color head 7. When the carriage 6 further moves toward the cleaning mechanism side, the slider 10 moves together with the carriage 6 and the slider 10 is pushed in to the position illustrated in FIG. 14 on the top of the cam surface 19*a* of the base. This enables the suction cap 12 to cap the color head 7.

Figure 10:
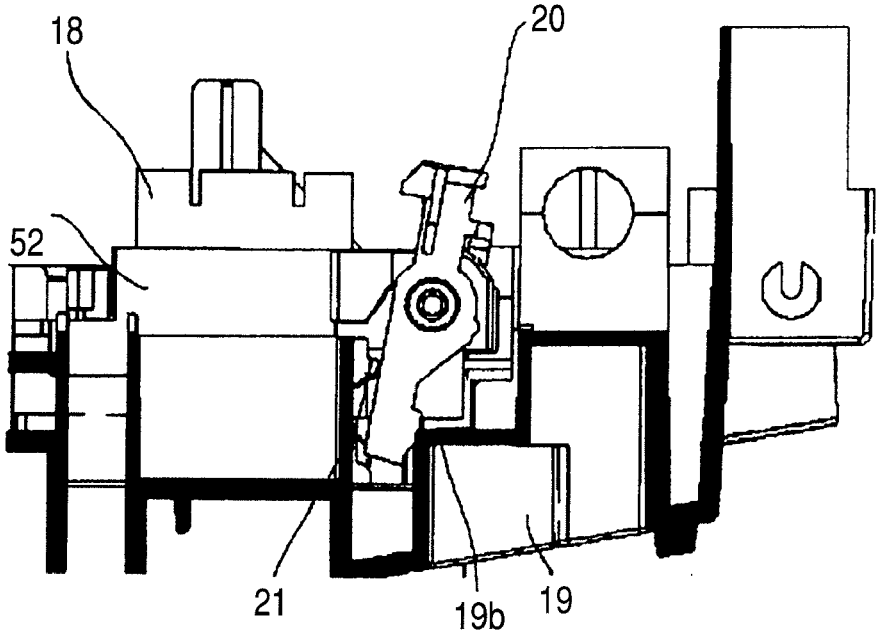
FIG. 10 is a schematic side view illustrating such a state that a slider is in a standby position.
Figure 12:
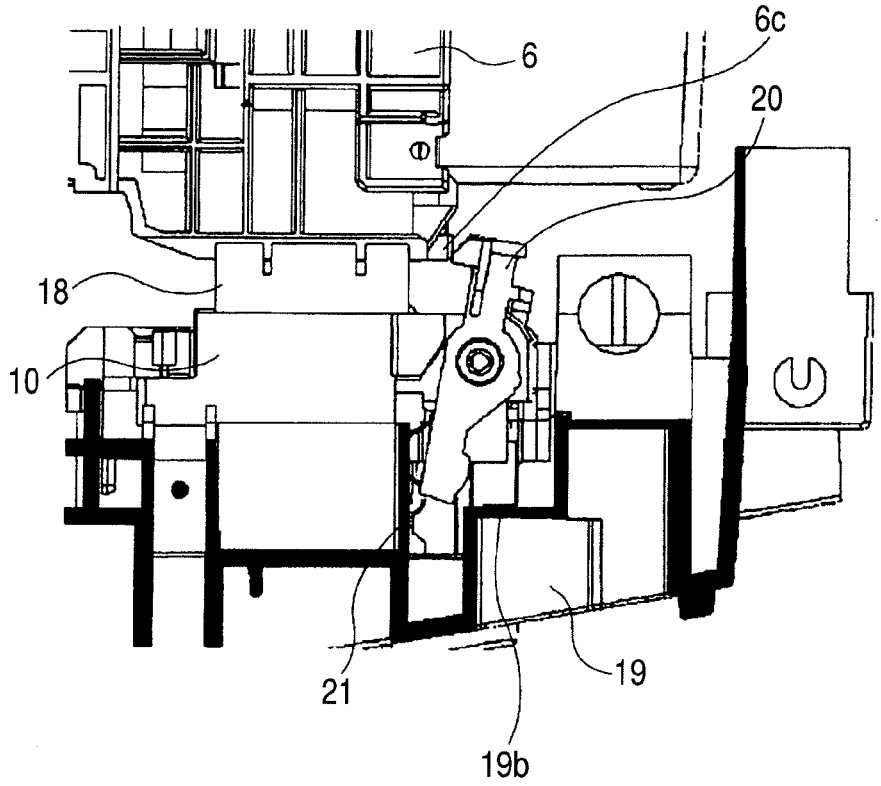
FIG. 12 is a schematic side view illustrating such a state that the slider is unlocked by the carriage.

When the slider 10 is pushed by the carriage 6 to move to the position of FIG. 13 or FIG. 14, a trigger lever 20 (FIG. 8) provided at the side of the slider 10 climbs over a seating face 19*b* of the base 19, and the direction of rotation is restricted. The following describes the movement of this trigger lever 20 with reference to FIG. 10 to FIG. 12. FIG. 10 to FIG. 12 are side views illustrating the cleaning mechanism as seen from the printing zone side.

FIG. 10 illustrates a state where the slider 10 is in the standby position. In this state, the force of a spring 21 is acting on the trigger lever 20 in the direction of rotation, and the tip end of the trigger lever 20 is statically determinate while contacting the side of the seating face 19*b* of the base 19. Then, when the slider 10 is pushed in by the carriage 6, and reaches the position illustrated in FIG. 11, the trigger lever 20 rotates to a position where the trigger lever 20 will climb over the seating face 19*b* of the base 19. After that, if the carriage 6 moves reversely toward the printing zone side, since the tip end of the trigger lever 20 is positioned on the seating face 19*b* of the base, the following of the carriage 6 by the slider 10 is stopped. Then, if the carriage 6 continues to move, a blade 18 held by the slider 10 will wipe the ink nozzle face of each of the print heads 7 and 8. Then, if the carriage 6 further continues to move toward the printing zone side, a lever releasing portion 6*c* of the carriage 6 will push down the top end of the trigger lever 20 as illustrated in FIG. 12. As a result, the locked state of the slider 10 on the seating face 19*b* of the base is released, so that the slider 10 can return to the statically determinate position illustrated in FIG. 10.

The operation will be described in further detail. When the carriage 6 is located outside the cleaning mechanism, the pump 40 is first driven to drive the pump roller 44 to rotate to a position where the tube 13 is crushed (FIG. 6).

When the suction of ink from the black head 8 is performed, the conveying roller 2 is driven to rotate the cam 54. As a result, the trigger lever 52 falls and enters a state where the trigger lever 52 does not come into contact with the carriage 6 as illustrated in FIG. 17 and FIG. 19. The carriage 6 is moved to bring the first contact portion 6*a* of the carriage 6 into contact with the contact portion 51 of the slider 10 (third contact portion), and the carriage 6 is further moved in that state to the position illustrated in FIG. 13. Then, the black head 8 is capped by the suction cap 12. When the pump 40 is driven again in this capped state, a negative pressure is generated in the cap, thereby sucking black ink. After that, when the carriage 6 is moved toward the printing zone side, wiping action after suction is performed with the above-mentioned structure. Note that the color head 7 is capped by the protective cap 11 when ink is sucked from the black head 8. Since no pressure is applied on the discharge nozzles of the color head, there is no need to perform preliminary discharge of color ink in vain.

When the suction of ink from the color head 7 is performed, the pump roller 44 is driven to rotate to the position where the tube 13 is crushed in the same manner as in the case of suction of black ink. The conveying roller 2 is driven to rotate the cam 54. The trigger lever 52 is displaced to enter a state where the trigger lever 52 can come into contact with the carriage 6 as illustrated in FIG. 18 and FIG. 20. When the carriage 6 moves toward the cleaning mechanism side, the second contact portion 6*b* of the carriage comes into contact with the trigger lever 52 (fourth contact portion). The carriage 6 is moved in that state to the position illustrated in FIG. 14. Then, the color head 7 is capped by the suction cap 12. When the pump 40 is driven again in this capped state, a negative pressure is generated in the cap, thereby sucking color ink.

When the print heads 7 and 8 are capped to prevent ink from adhering to the nozzles when not in use, the trigger lever 52 is placed in the position of FIG. 17 and FIG. 19. Then, the slider 10 is moved by the carriage 6 to the position of FIG. 13 in such a state that the tube 13 is not crushed by the pump roller 44. After that, both of the print heads 7 and 8 are capped.

Second Embodiment

In the first embodiment, the mechanism for changing the positional relationship between the carriage and the slider is provided on the cleaning mechanism side. The following describes a second embodiment in which the changing mechanism is provided on the carriage side.

Figure 21:
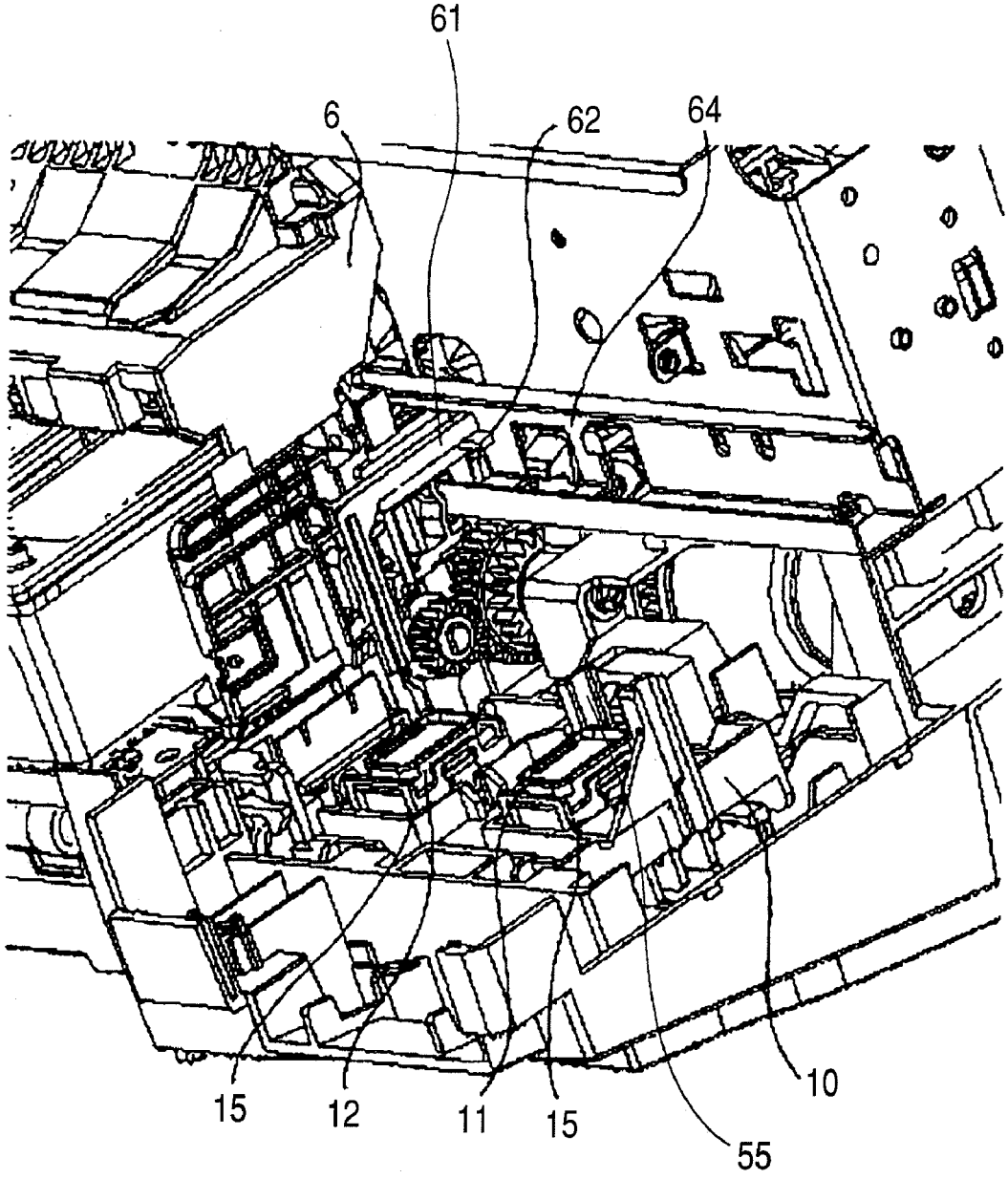
FIG. 21 is a view illustrating a positional relationship between a cleaning mechanism and the carriage in a second embodiment.
Figure 22:
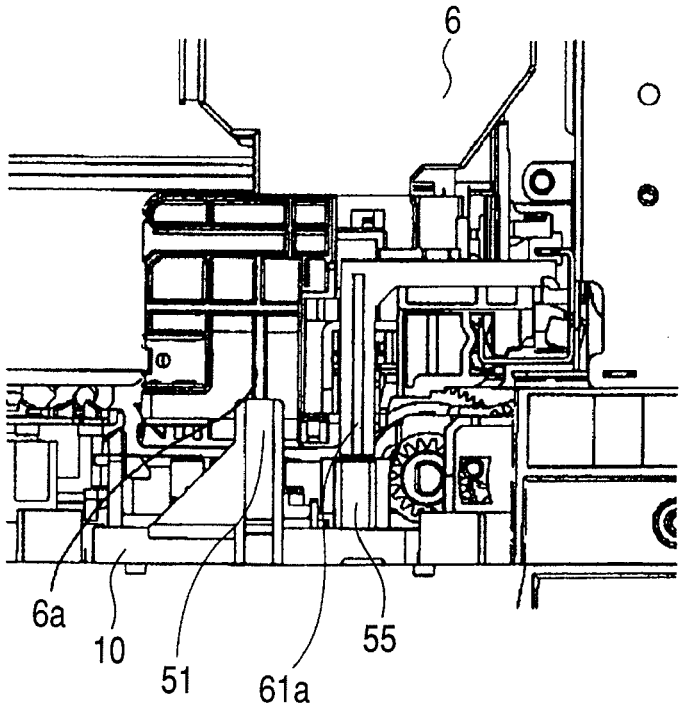
FIG. 22 is a side view illustrating a positional relationship when suction from the black head is performed.
Figure 23:
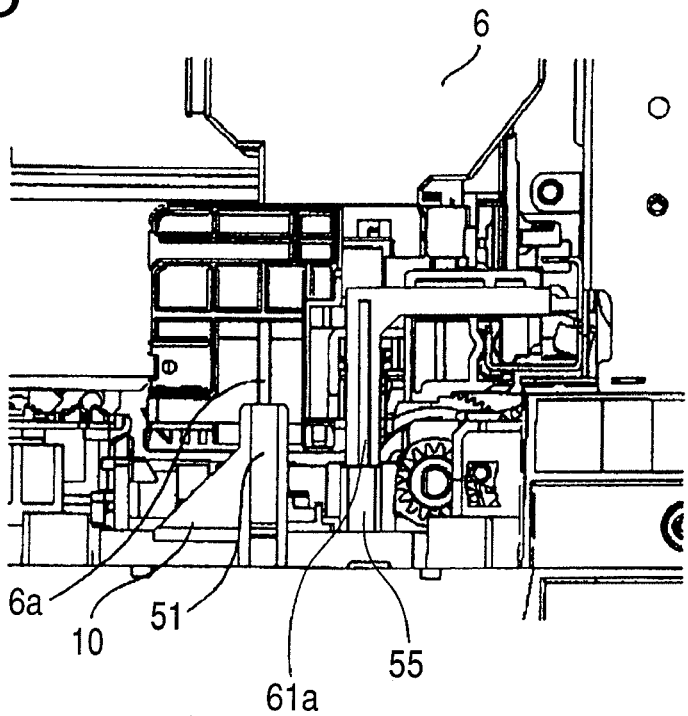
FIG. 23 is a side view illustrating a positional relationship when suction from the color head is performed.
Figure 24:
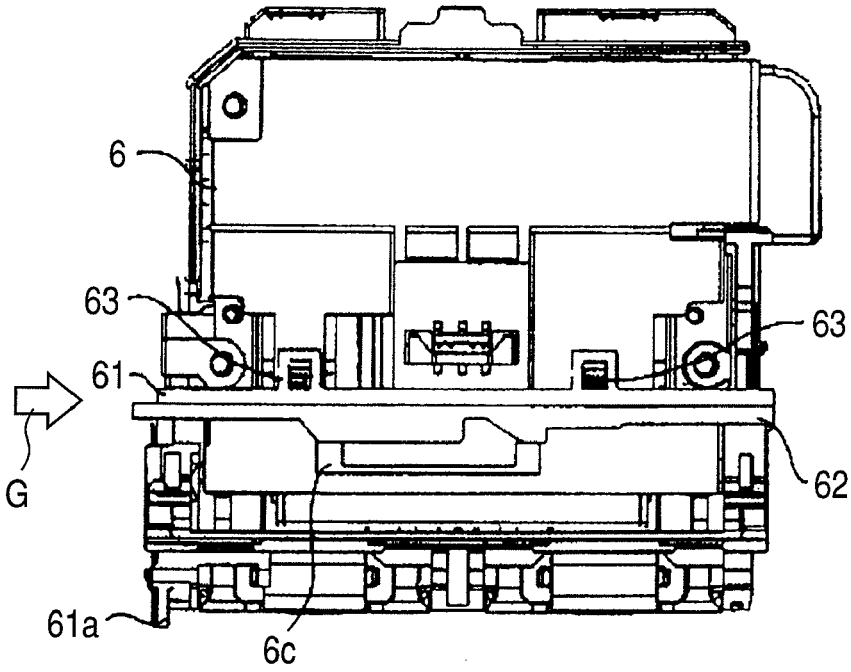
FIG. 24 is a view illustrating a positional relationship when suction from the black head is performed.
Figure 25:
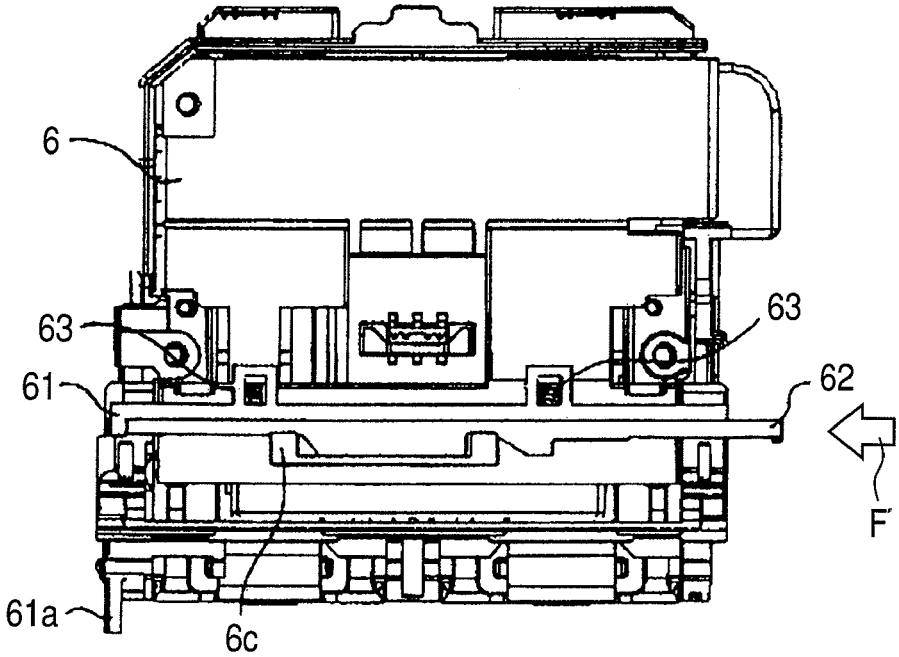
FIG. 25 is a view illustrating a positional relationship when suction from the color head is performed.

FIG. 21 is a top perspective view illustrating a positional relationship between the cleaning mechanism and the carriage 6. FIG. 22 is a side view illustrating a positional relationship between the carriage 6 and the slider 10 when the suction of ink from the black head 8 is performed. FIG. 23 is a side view illustrating a positional relationship between the carriage 6 and the slider 10 when the suction of ink from the color head 7 is performed. FIG. 24 is a view illustrating a positional relationship between the carriage 6 and a contact member 61 when the suction of ink from the black head 8 is performed. FIG. 25 is a view illustrating a positional relationship between the carriage 6 and the contact member 61 when the suction of ink from the color head 7 is performed.

As illustrated in FIG. 24 and FIG. 25, the carriage 6 includes a cam surface 6*c*, a slide member 62, and the contact member 61. The contact member 61 is pressed by a compression spring 63 on the slide member 62. A contact surface having steps is formed at the bottom of the slide member 62. The contact surface and the cam surface 6*c* of the carriage are in contact with each other at two points. When an external force is exerted on the slide member 62 from the main scanning direction of the carriage 6, the slide member 62 slides laterally to change the position of contact with the cam surface 6*c*. The change in the contact surface displaces the vertical positions of the contact member 61 and a second contact portion 61*a* of the carriage, which is provided integrally with the contact member 61, depending on the heights of the stepped portions of the contact surface of the slide member 62. FIG. 24 illustrates such a state that the slide member 62 and the contact member 61 have moved up. Here, if a force is exerted on the slide member 62 in the direction of arrow G, the slide member 62 moves laterally to change the position of contact with the cam surface 6*c*, entering a state of FIG. 25. In FIG. 25, the contact member 61 and the second contact portion 61*a* are displaced to a down position. Conversely, if a force is exerted on the slide member 62 in the direction of arrow F from the state of FIG. 25, the slide member 62 moves laterally to enter the state of FIG. 24.

In FIG. 21, a trigger lever 64 is means for moving the slide member 62 laterally. The trigger lever 64 is provided in a moving area closer to the printing zone side than the position where the carriage 6 comes into contact with the slider 10. The trigger lever 64 can project or retract selectively by switching the direction of driving the conveying roller 2 between the forward and reverse directions of rotation. If the carriage 6 moves to the cleaning mechanism side in such a state that the trigger lever 64 is projecting, the slide member 62 bumps into the trigger lever 64 and moves laterally, enabling the contact member 61 and the second contact portion 61*a* to enter the down state (FIG. 25). On the other hand, if the carriage 6 is moved counter to the cleaning mechanism over the printing zone to make the slide member 62 bump into the side plate of the chassis 1, the contact member 61 and the second contact portion 61*a* enter the up state (FIG. 24).

When the suction of ink from the black head 8 is performed, the contact member 61 and the second contact portion 61*a* of the carriage enter the up state as illustrated in FIG. 24. As a result, the second contact portion 61*a* of the carriage and a second contact portion 55 of the slider does not come into contact with each other as illustrated in FIG. 22. In this state, if the carriage 6 moves to the cleaning mechanism side, the first contact portion 6*a* of the carriage first comes into contact with a contact portion 51 of the slider (third contact portion). This results in determining the relative position of the carriage 6 and the slider 10 in such a manner that the suction cap 12 faces the nozzles of the black head 8 and the protective cap 11 faces the nozzles of the color head 7. When the carriage 6 further moves from this state, the slider 10 is pushed in to the position illustrated in FIG. 13 on the top of the cam surface 19*a* of the base. This enables the suction cap 12 to cap the black head 8 and the protective cap 11 to cap the color head 7.

On the other hand, when the suction of ink from the color head 7 is performed, the contact member 61 and the second contact portion 61*a* enter the down state as illustrated in FIG. 25. As a result, the second contact portion 61*a* of the carriage and the second contact portion 55 of the slider are so positioned that they can come into contact with each other as illustrated in FIG. 23. In this state, if the carriage 6 moves toward the cleaning mechanism side, the second contact portion 61*a* of the contact member 61 first comes into contact with the second contact portion 55 of the slider. This results in determining the relative position of the carriage 6 and the slider 10 in such a manner that the suction cap 12 faces the nozzles of the color head 7. When the carriage 6 further moves from this state, the slider 10 is pushed in to the position illustrated in FIG. 14 on the top of the cam surface 19*a* of the base. This enables the suction cap 12 to cap the color head 7.

The operation will be described in further detail. When the carriage 6 is located outside the cleaning mechanism, the pump 40 is first driven to drive the pump roller 44 to rotate to a position where the tube 13 is crushed (FIG. 6).

When the suction of ink from the black head 8 is performed, the carriage 6 is moved counter to the cleaning mechanism over the printing zone to make the slide member 62 bump into the side plate of the chassis 1. At this time, the contact member 61 and the second contact portion 61*a* enter the state as illustrated in FIG. 24, where the heights thereof are raised. Then, the carriage 6 is moved toward the cleaning mechanism side to make the first contact portion 6*a* of the carriage come into contact with the contact portion 51 of the slider (third contact portion), and the carriage 6 is further moved in that state to the position illustrated in FIG. 13. Then, the black head 8 is capped by the suction cap 12 to perform suction.

When the suction of ink from the color head 7 is performed, the carriage 6 is moved to make the slide member 62 bump into the projecting trigger lever 64, entering such a state that the contact member 61 is lowered. In this state, if the carriage 6 moves toward the cleaning mechanism side, the second contact portion 61*a* of the contact member 61 first comes into contact with the second contact portion 55 of the slider 10. The carriage 6 is moved in that state to the position illustrated in FIG. 14. Then, the color head 7 is capped by the suction cap 12 to perform suction.

As described above in the first and the second embodiments, the cleaning mechanism has the slider that moves together with the carriage, and two or more caps provided on the slider to cap print heads mounted on the carriage. The two or more caps include a suction cap for sucking ink from nozzles of a black or color head and a protective cap for capping to protect a face where nozzles of a head other than the head capped by the suction cap are formed. Further, the first contact portion and the second contact portion are provided in each of the carriage and the slider, and the third contact portion and the fourth contact portion are provided in the slider. In the case that a first print head is capped by the suction cap to perform suction, when the carriage moves toward the cleaning mechanism side from the printing zone, the first contact portion and the third contact portion come into contact with each other, positioning the carriage and the slider to make the suction cap face the first print head (the black head 8 discharging black pigmented ink). On the other hand, in the case that a second print head (the color head 7 discharging color dye ink) is capped by the suction cap to perform suction, when the carriage moves toward the cleaning mechanism side from the printing zone, the second contact portion and the fourth contact portion come into contact with each other, positioning the carriage and the slider to make the suction cap face the second print head. Such a simple structure enables suction of ink from a print head to be cleaned among the two or more print heads mounted on the carriage, reducing unwanted discharge of ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-153999, filed on Jun. 12, 2008, which is hereby incorporated by reference herein in its entirety.

What is claimed is:

1. A printer comprising:

a carriage with a first print head and a second print head mounted thereon moving reciprocally, the first print head and the second print head having nozzles for discharging ink toward a print medium, respectively;

a first cap for capping the first print head or the second print head to suction ink from the first print head or the second print head, the first cap being connected to a pump to generate a negative pressure in the first cap;

a second cap for capping the second print head, the second cap being not connected to the pump;

a slider moving together with the carriage, the first cap and the second cap being disposed on the slider;

a first contact portion provided on the slider to contact the carriage, the carriage moving in a condition that the carriage is in contact with the first contact portion, thereby the carriage moving to a first position where the first print head is capped with the first cap and the second print head is capped with the second cap; and a second contact portion provided on the slider and movable between a first position where the second contact portion is contactable with the carriage and a second position where the second contact portion is not contactable with the carriage, the carriage moving in a condition that the carriage is in contact with the second contact portion, thereby the carriage moving to a second position where the second print head is capped with the first cap and the first print head is not capped.

2. The printer according to claim 1, wherein the second contact portion is swingable relative to the slider.

3. The printer according to claim 1, wherein the first print head discharges pigment ink and the second print head discharges dye ink.

4. The printer according to claim 3, wherein the pigment ink is black ink and the dye ink is color ink.

5. The printer according to claim 1, wherein the first cap is located closer than the second cap to a printing zone of the print medium.

* * * * *